US011491082B2

(12) United States Patent
Nisler et al.

(10) Patent No.: US 11,491,082 B2
(45) Date of Patent: Nov. 8, 2022

(54) COVER FOR DRUG PRODUCT BOTTLES

(71) Applicant: BioFlex Solutions, LLC, Hackettstown, NJ (US)

(72) Inventors: Jason C. Nisler, Newton, NJ (US); Ralph M. Meola, Hackettstown, NJ (US)

(73) Assignee: BioFlex Solutions, LLC, Hackettstown, NJ (US)

( * ) Notice: Subject to any disclaimer, the term of this patent is extended or adjusted under 35 U.S.C. 154(b) by 198 days.

(21) Appl. No.: 16/537,853

(22) Filed: Aug. 12, 2019

(65) Prior Publication Data

US 2020/0060932 A1 Feb. 27, 2020

Related U.S. Application Data

(60) Provisional application No. 62/720,273, filed on Aug. 21, 2018.

(51) Int. Cl.

| | |
|---|---|
| ***B65D 55/02*** | (2006.01) |
| ***A61J 1/14*** | (2006.01) |
| ***B65D 51/24*** | (2006.01) |
| ***B65D 55/08*** | (2006.01) |
| *B65D 23/10* | (2006.01) |

(52) U.S. Cl.

CPC ..... *A61J 1/1418* (2015.05); *B65D 51/242* (2013.01); *B65D 55/02* (2013.01); *B65D 55/0863* (2013.01); *B65D 23/108* (2013.01); *B65D 2255/06* (2013.01)

(58) Field of Classification Search

CPC ..... B65D 23/108; B65D 51/18; B65D 41/34; B65D 41/62; B65D 55/02

See application file for complete search history.

(56) References Cited

U.S. PATENT DOCUMENTS

| | | | | | |
|---|---|---|---|---|---|
| 208,193 | A * | 9/1878 | Michel | B65D 41/28 | 215/277 |
| 4,254,888 | A * | 3/1981 | Chandler | B60K 15/0409 | 220/210 |
| 4,271,972 | A * | 6/1981 | Thor | B65D 55/02 | 215/251 |
| 4,405,161 | A * | 9/1983 | Young | E21B 33/03 | 285/80 |
| 4,609,217 | A * | 9/1986 | Nielsen, Jr. | F16B 41/007 | 292/307 B |
| 5,092,359 | A * | 3/1992 | Wirth | E21B 34/02 | 137/382 |
| 5,323,517 | A * | 6/1994 | Su | A61J 11/04 | 24/20 EE |

(Continued)

FOREIGN PATENT DOCUMENTS

WO WO-9303702 A1 * 3/1993 ..... A61J 1/10

*Primary Examiner* — Mollie Impink

(74) *Attorney, Agent, or Firm* — KDB Firm PLLC

(57) ABSTRACT

The cover is made with two parts that close on each other over a cap on a drug product bottle. Each cover part has a semi-cylindrical periphery, a semi-circular lid and a radially inwardly directed ledge along a bottom edge of the semi-cylindrical periphery to fit under the cap of a bottle in a closed position. The cover parts snap together to lock in place. In one embodiment, the cover cooperates with a handle assembly having a handle of U-shape that is disposed over the cover to prevent separation of the two parts from each other.

23 Claims, 8 Drawing Sheets

(56) References Cited

U.S. PATENT DOCUMENTS

| | | | | |
|---|---|---|---|---|
| 8,091,727 | B2 * | 1/2012 | Domkowski | A61J 1/1406 215/251 |
| 2005/0205436 | A1 * | 9/2005 | Erickson | B65D 23/108 206/139 |
| 2015/0302232 | A1 * | 10/2015 | Strassburger | B65D 43/0235 340/10.1 |

* cited by examiner

COVER FOR DRUG PRODUCT BOTTLES

This is a Non-Provisional Patent Application and claims the benefit of Provisional Patent Application 62/720,273, filed Aug. 21, 2018.

This invention relates to a cover for drug product storage bottles.

As is known, the pharmaceutical and biotech industries commonly store, freeze, ship and transport expensive drug product in various plastic bottles and containers. Due to the high value of the drug product, it is essential to maintain the bottled product safely and with integrity. To this end, the bottles must remain sealed from the atmosphere once filled with the product, usually a liquid, and undamaged until use, for example in a final step of a drug manufacturing process.

In addition to maintaining and protecting the bottled drug product, the tops of the storage bottles must be protected from damage.

Accordingly, it is an object of the invention to provide a cover for a drug product bottle that maintains and protects a drug product within the bottle.

It is another object of the invention to provide a lockout for a drug product storage bottle.

It is another object of the invention to provide a temper evident seal for a drug product storage bottle.

Briefly, the invention provides a cover that will fit and encapsulate a bottle top screw cap of a drug product bottle and any ancillary fittings or tube connections penetrating through the cap.

The cover serves two primary purposes. One will be to protect the bottle cap and assembly from damage during storage, handling or transit. The second purpose will be to serve as a tamper evident mechanism which will protect a valuable drug product within the bottle from the bottle mistakenly being opened and to ensure that the drug product remains unadulterated.

The cover is of two part construction with parts that hinge or clamp around the cap and are secured on a neck of the bottle to prevent removal of the cover or the screw cap after installation.

The two parts of the cover are constructed to snap shut on each other via an undercut barb that secures the two halves closed around the bottle cap. Once installed in place, the cover cannot be removed without cutting or damaging the parts.

The cover parts may be provided with aligning loops to allow users to fasten the two parts together using a tie or other mechanism.

The cover is manufactured using plastic components, in which case, the plastic parts may be integrally hinged together. Alternatively, one part may be made of a plastic while the other part is made of metal. In this latter case, the parts are separately made and are hinged together by a pin or rivet.

Once removed from a capped drug product bottle, the cover is not intended to be re-used.

In one embodiment, the cover comprises a pair of parts that are hingedly secured together to move between an open position and a closed position. When in the closed position the two parts are in facing relation to each other to form a cup shape. Each part has a semi-cylindrical periphery, a semi-circular lid and a radially inwardly directed ledge along a bottom edge of the semi-cylindrical periphery to fit under the cap of the bottle in the closed position. In addition, a lip projects from the periphery and the lid of one part for slidable reception within the other part in the closed position to seal the parts together in face-to-face manner.

The cover also has a locking means for securing the hinged parts together in the closed position. This locking means includes a radially directed integral abutment with a slot of rectangular shape on the periphery of one part and an integral tab with a barb on the other part sized to slide through the slot and to engage behind the abutment in the closed position.

The cover may also have an aligning loop on each part for receiving a fastening mechanism, such as a tie.

This embodiment is used with a drug product bottle having a neck and a screw cap threadably secured to the neck, In use, the cover is mounted over the screw cap by placing the ledge of one cover part under the cap and then pivoting the other cover part into the closed position to snap-fit into the first cover part with the ledge of the pivoted cover part moving under the cap. Once the covers are secured together, the cover rests on the neck of the bottle.

The cover is dimensioned so that, once in place, with the cover in contact with the neck of the bottle, the lids of the cover are spaced from the top of the screw cap.

Bottles of pharmaceutical drug product can be difficult to handle and require a separate method to carry. This is due to the low temperature of the product or the types of bottles that may not be able to be produced with an integral carrying handle. Accordingly, in another embodiment, the cover includes a handle assembly that allows a bottle to be carried.

In this embodiment, the handle assembly includes a disc-shaped plate having a pair of tabs slidably receiving the ledge of one of the hinged parts to fix the plate to that hinged part in the open position. After one hinged part of the cover is attached to the plate of the handle assembly, the other part can be pivoted over the plate to move between the open position and the closed position.

The handle assembly also has a U-shaped handle secured to the plate for movement between a first position extending radially from the plate and a second position extending perpendicularly from the plate to be disposed over the hinged parts when in the closed position to prevent separation of parts from each other.

This embodiment is used with a drug product bottle having a neck, a cap threadably secured to the neck and an annular collar or projection on the neck under the screw cap. In use, the plate of the handle assembly is mounted on the bottle to project radially inwardly of and under the collar on the neck of the bottle. Typically, the plate is snapped into place on the bottle before the cap is put on the bottle.

Thereafter, one of the parts of the cover is slidably mounted under the tabs on the plate in the open position of the cover. At this time, the cover part is also positioned over the screw cap on the bottle and the ledge of the cover part is disposed under the screw cap and under the collar on the neck of the bottle.

Next, the other cover part is pivoted over the plate into the closed position to snap-fit into the first cover part with the ledge of the pivoted cover part moving under the cap and the collar on the neck of the bottle.

Thereafter, the handle of the handle assembly is pivoted upwardly over the cover to prevent separation of the cover parts from each other.

The cover of this embodiment also has a pair of radially inwardly directed semi-circular flanges on each part with one flange being disposed to rest on the screw cap and the other flange being disposed circumferentially of the screw cap. These flanges serve to center the cover and locate the cover on the screw cap of the bottle at the correct height while providing structural support to the assembly.

As with the first embodiment, the cover of the second embodiment is dimensioned so that, once in place, with the plate of the handle assembly in contact with the neck of the bottle, the lids of the covers are spaced from the top of the screw cap.

These and other objects of the invention will become more apparent form the following detailed description taken in conjunction with the accompanying drawings wherein.

Figure 1:
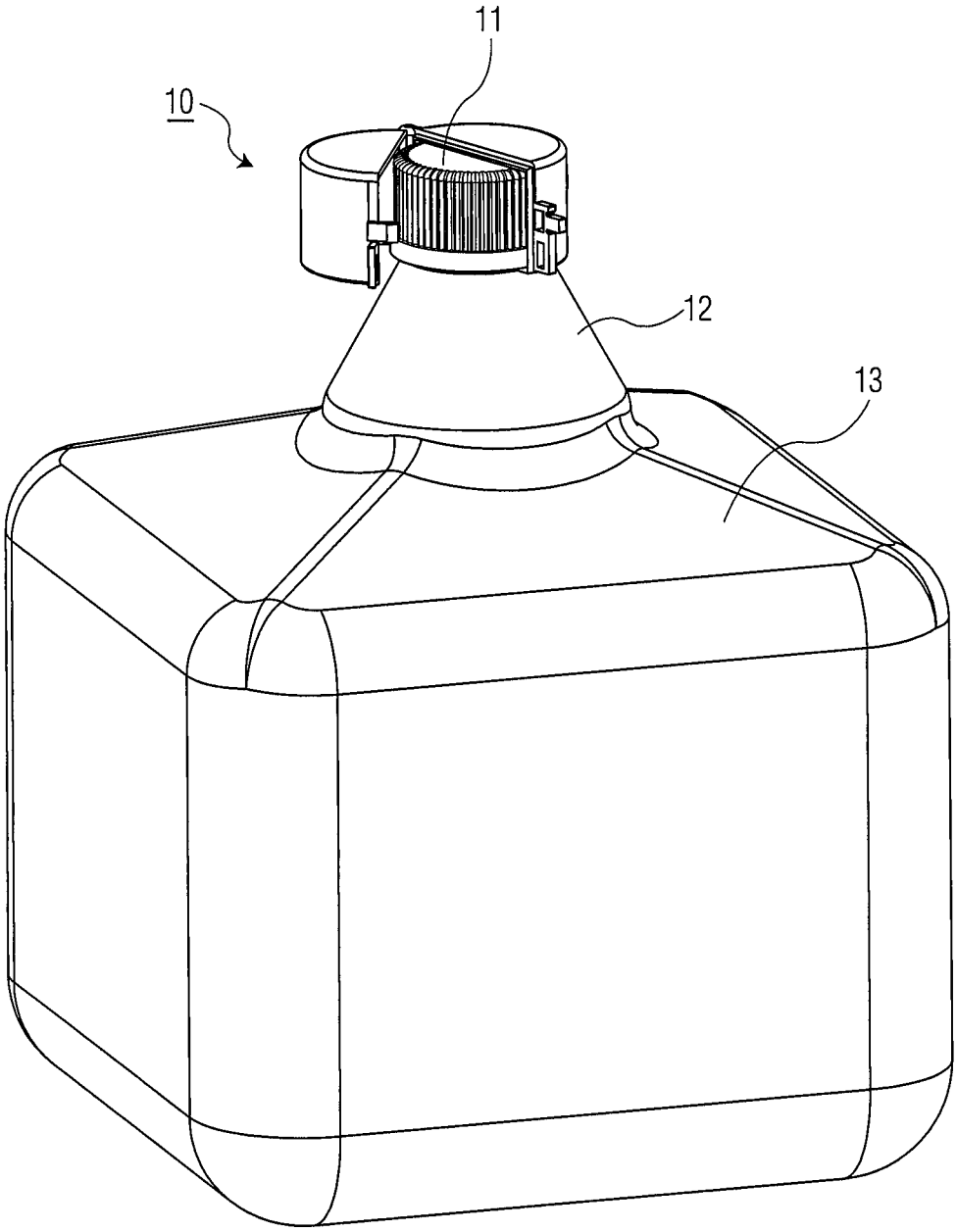
FIG. 1 illustrates a perspective view of a drug product bottle having a cover in accordance with the invention being secured in place.

Referring to FIG. 1, the cover 10 is constructed for use on a screw cap 11 on a neck 12 of a drug product bottle 13 containing a drug product, typically in liquid form and of a valuable nature, in order to protect the cap 11 against damage during storage, handling or transit. The cover 10 also serves as a tamper evident mechanism which will protect the valuable drug product within the bottle 13 from being mistakenly opened while ensuring that the drug product remains unadulterated.

Figure 2:
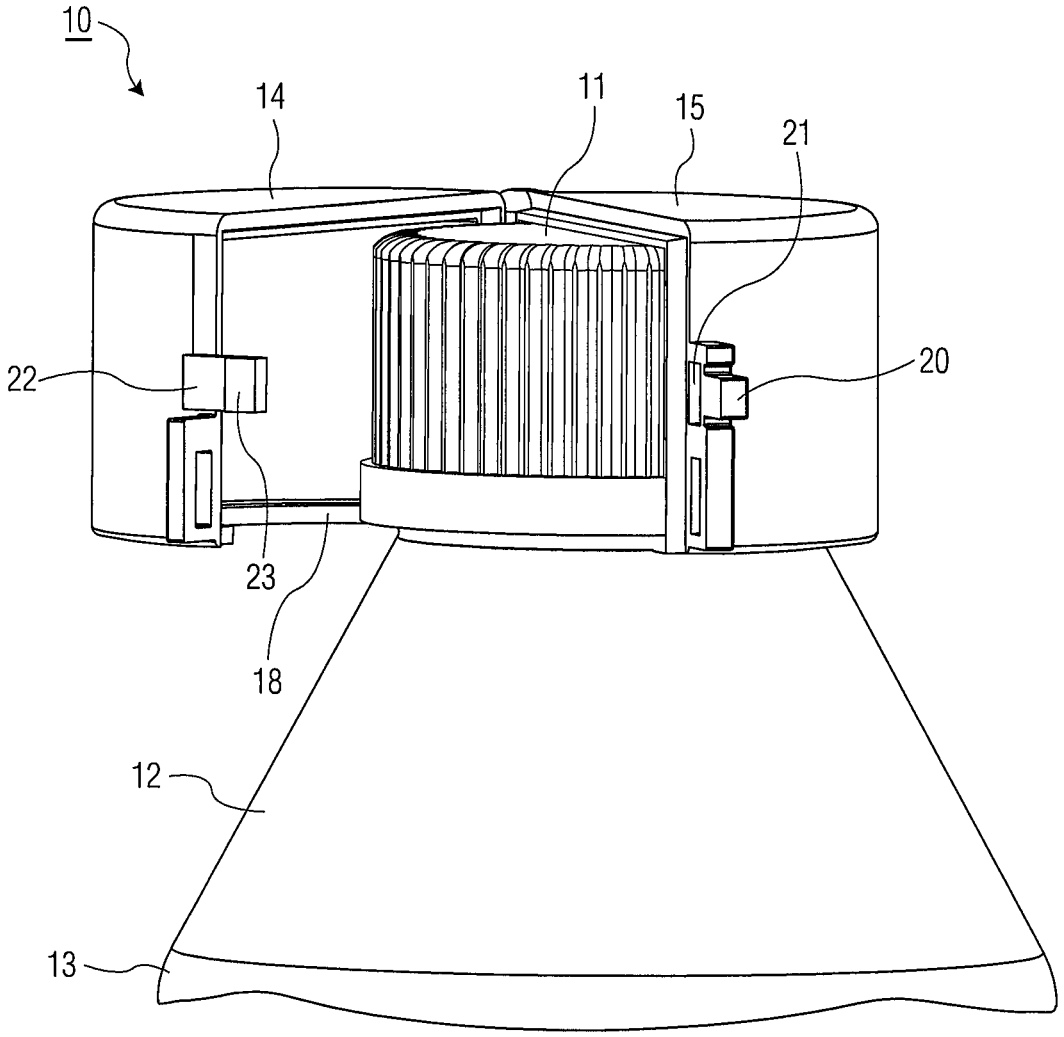
FIG. 2 illustrates an enlarged perspective view of the top of the drug product bottle and cover of FIG. 1.

Referring to FIG. 2, wherein like reference characters indicate like parts as above, the cover 10 is formed of two parts 14, 15 that are hinged together.

The two parts 14, 15 of the cover 10 are made of plastic material, such as, polyethylene, polypropylene and polyvinylidene fluoride (PVDF) and are integrally hinged together.

Alternatively, the two parts 14, 15 may be separately made, for example, being made of plastic and/or metal, and hinged together via a pin or rivet.

Figure 3:
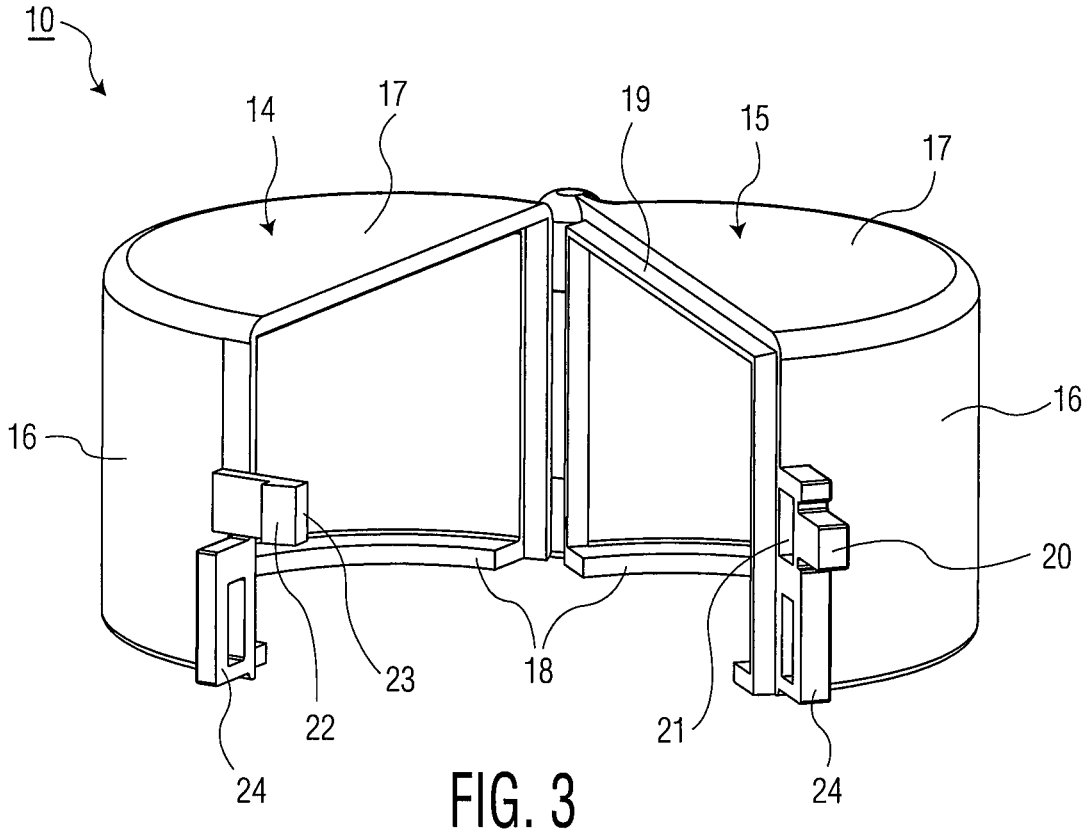
FIG. 3 illustrates a perspective view of the cover of FIG. 1.

Referring to FIGS. 3, wherein like reference characters indicate like parts as above, the two parts 14, 15 of the cover 10 form a cup shape when closed together on each other. As illustrated, each part 14, 15 has a semi-cylindrical periphery 16 and a semi-circular lid 17. In addition, each part 14, 15 has a radially inwardly directed ledge 18 along the bottom edge, as viewed, of the semi-cylindrical periphery 16 to fit under the cap 11 of the bottle 13 shown in FIG. 2 when the two parts 14, 15 are closed on each other.

One part 15 also has a lip 19 that projects from the periphery 16 and the lid 17 towards the other part 14 and is sized to be slidably received within the other part 15 when the two parts 14, 15 are closed on each other. The lip 19 serves to seal the two parts 14, 15 together in face-to-face manner when the two parts 14, 15 are closed on each other by being slidably disposed within the other part 15.

One part 15 also has a radially directed integral abutment 20 on the outside of the periphery 16 adjacent an edge of the part 15 facing the other part 14. The abutment 20 is located at a mid-point of the periphery 16 and is formed with a slot 21 of rectangular shape.

The other part 14 has an integral tab 22 that projects from a mid-point of the part 14 towards the abutment 20 on the other part 15. This tab 22 has a barb 23 at the end that is sized to slide through the slot 21 of the abutment 20 and to engage behind the abutment 20 when the two parts 14, 15 are closed on each. The locking of the tab 22 to the abutment 20 serves as a secure lock for the cover 10 when closed and is intended to be permanent to the extent that the tab 22 cannot be withdrawn for the abutment without destroying the tab 22 and/or abutment 20.

Each part 14, 15 is also provided with an aligning loop 24, for example, of rectangular shape, to allow a user to fasten the two parts 14, 15 together using a tie or other mechanism (not shown).

Referring to FIG. 2, in use, the cover 10 is first positioned about the cap 11 of the bottle 13 so that the ledge 18 of one part 15 is positioned under the cap 11 with the lid 17 over the cap 11. The other part 14 is then pivoted into engagement with the positioned part 14 causing the tab 22 on the pivoting part 14 to pass through the slot 21 of the abutment 20 and lock the two parts together.

Once in place, the cover 10 cannot be readily removed without cutting or damaging the parts 14, 15. Further, the cover 10 rides on the bottle geometry so that there is a gap between the cover 10 and the top of the cap 11. Thus, the cap 11 cannot be readily gripped manually and cannot be unscrewed from the neck 12 of the bottle 13 by turning of the cover 10. Instead, the cover 10 is able to rotate about the cap 11 without interference.

Figure 4:
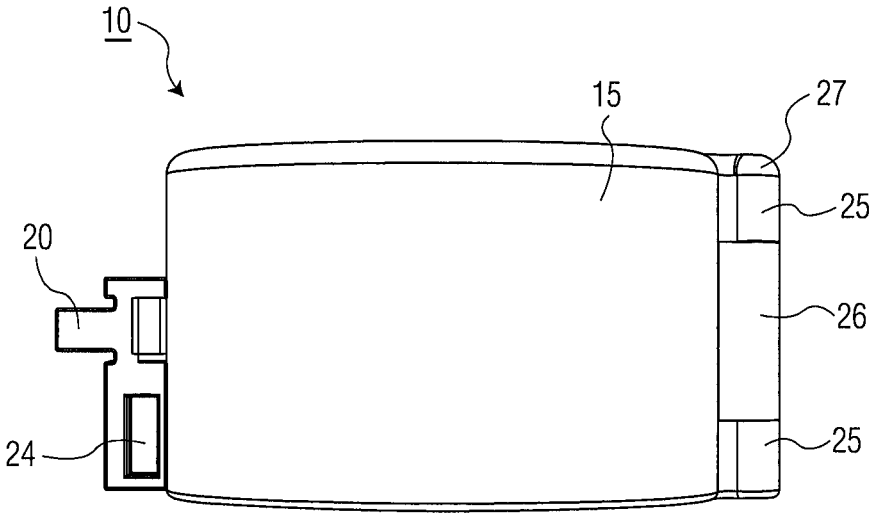
FIG. 4 illustrates a side view of the cover of FIG. 1.

Referring to FIG. 4, wherein like reference characters indicate like parts as above, the two parts 14, 15 of the cover 10 may be separately made and secured together in a mechanical manner. For example, one part 15 may be made with two hollow ears 25 while the other part (not shown) is made with a single hollow ear 26 that fits in alignment with the ears 25 of the one part 15. In addition, a pin 27 or rivet (not shown) is passed into and through the ears 25, 26 to join the two parts 14, 15 together in hinged manner.

As indicated in FIGS. 1 and 2, the cover 10 is of a shape and size to conform to the shape and size of the cap 11 thereby being of limited bulk.

Figure 5:
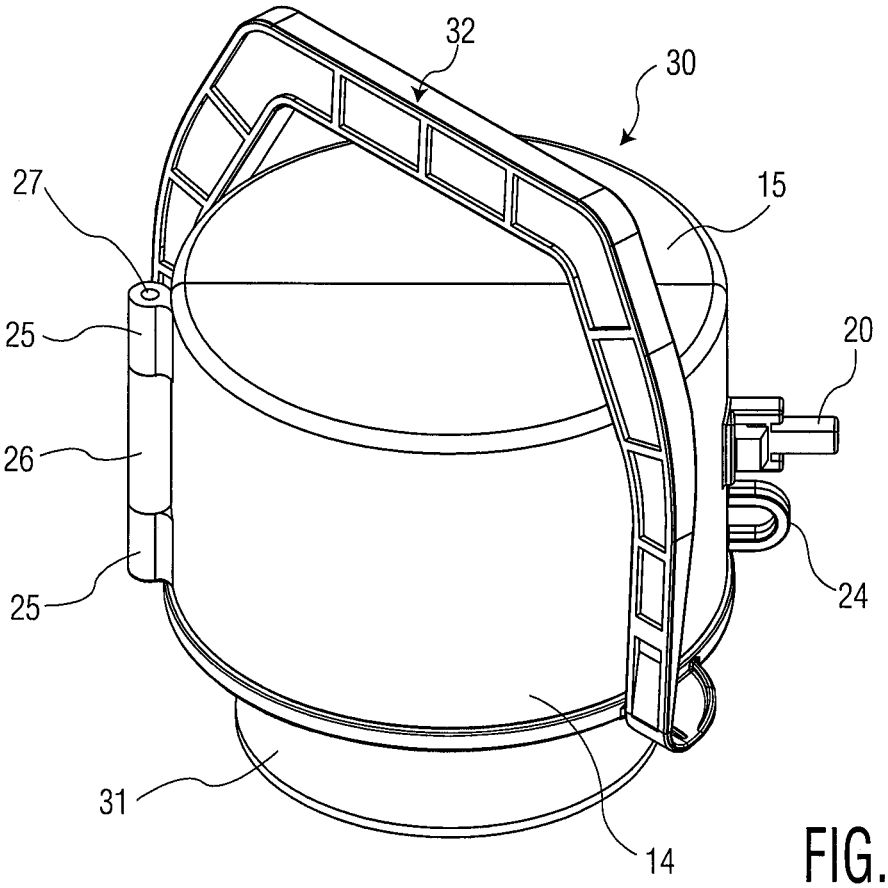
FIG. 5 illustrates a perspective view of a modified cover on a drug product bottle with a handle assembly according to the invention.
Figure 6:
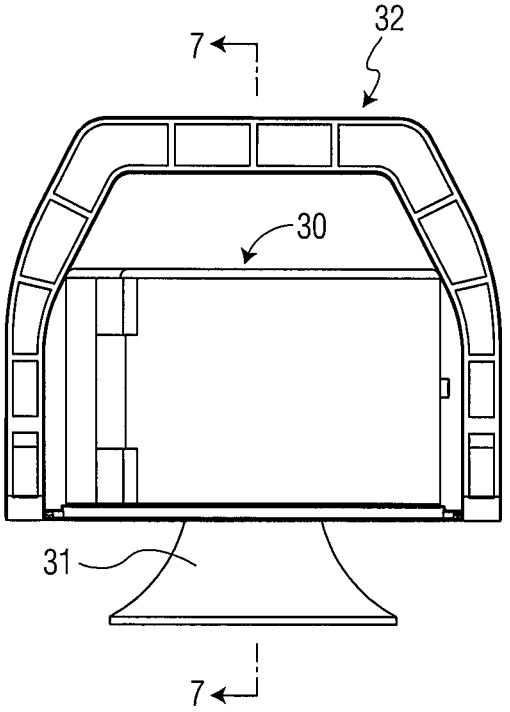
FIG. 6 illustrates a front view of the cover of FIG. 5.

Alternatively, in another embodiment as shown in FIGS. 5 and 6, the cover 30 may be of larger size and shape than the cap 11 on a bottle 31 (shown in part) in order to employ a handle assembly 32 to facilitate handling of a filled bottle 31.

Referring to FIGS. 5 and 6, wherein like reference characters indicate like parts as above, the cover 30 is formed of two parts 14, 15 that are hinged together. As above, one part 15 is made with two hollow ears 25 while the other part is made with a single hollow ear 26 that fits in alignment with the ears 25 of the one part 15. In addition, a pin 27 is passed into and through the ears 25, 26 to join the two parts 14, 15 together in hinged manner.

One part 15 also has a radially directed integral abutment 20 on the outside formed with a slot (not shown) while the other part 15 has an integral tab 22 with a barb 23 at the end that is sized to slide through the slot (not shown) of the abutment 20 and to engage behind the abutment 20 when the two parts 14, 15 are closed on each.

Each part 14, 15 is also provided with an aligning loop 24 (only one of which is shown) to allow a user to fasten the two parts 14, 15 together using a tie or other mechanism (not shown).

Figure 8:
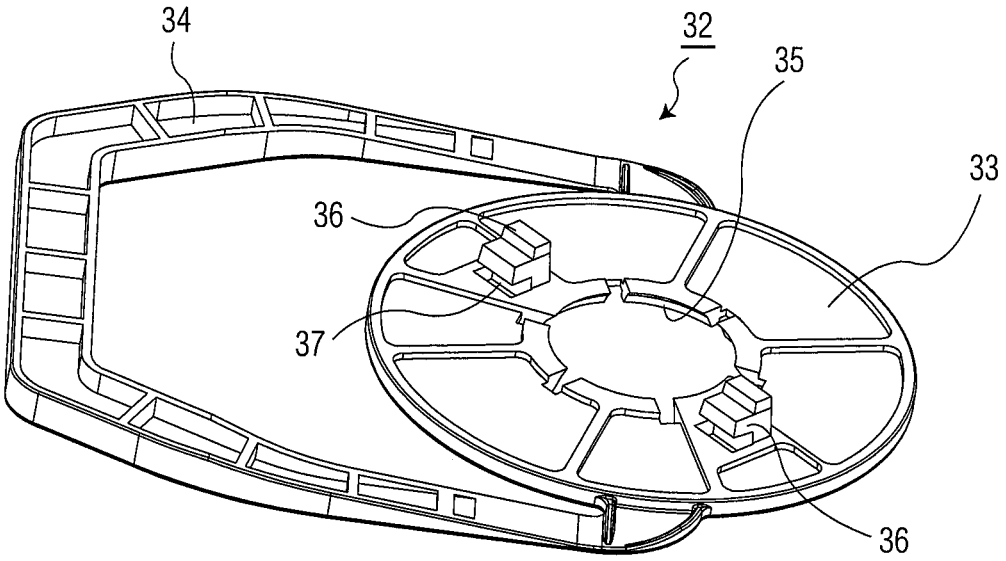
FIG. 8 illustrates a perspective view of the handle assembly of FIG. 5.

Referring to FIG. 8, the handle assembly 32 includes a disc-shaped plate 33 and a U-shaped handle 34 secured to the plate 33 for movement between a first position extending radially from the plate 33, as shown, and a second position extending perpendicularly from the plate 33 (see FIG. 5).

The disc-shaped plate 33 has a central opening 35 and a pair of tabs 36 with an undercut 37 that are located on diametrically opposite sides of the opening 35 for slidably receiving the ledge 18 of one cover part 16 (see FIG. 9) to fix the cover part 14 to the plate 33 in the open position of the cover 30.

Figure 7:
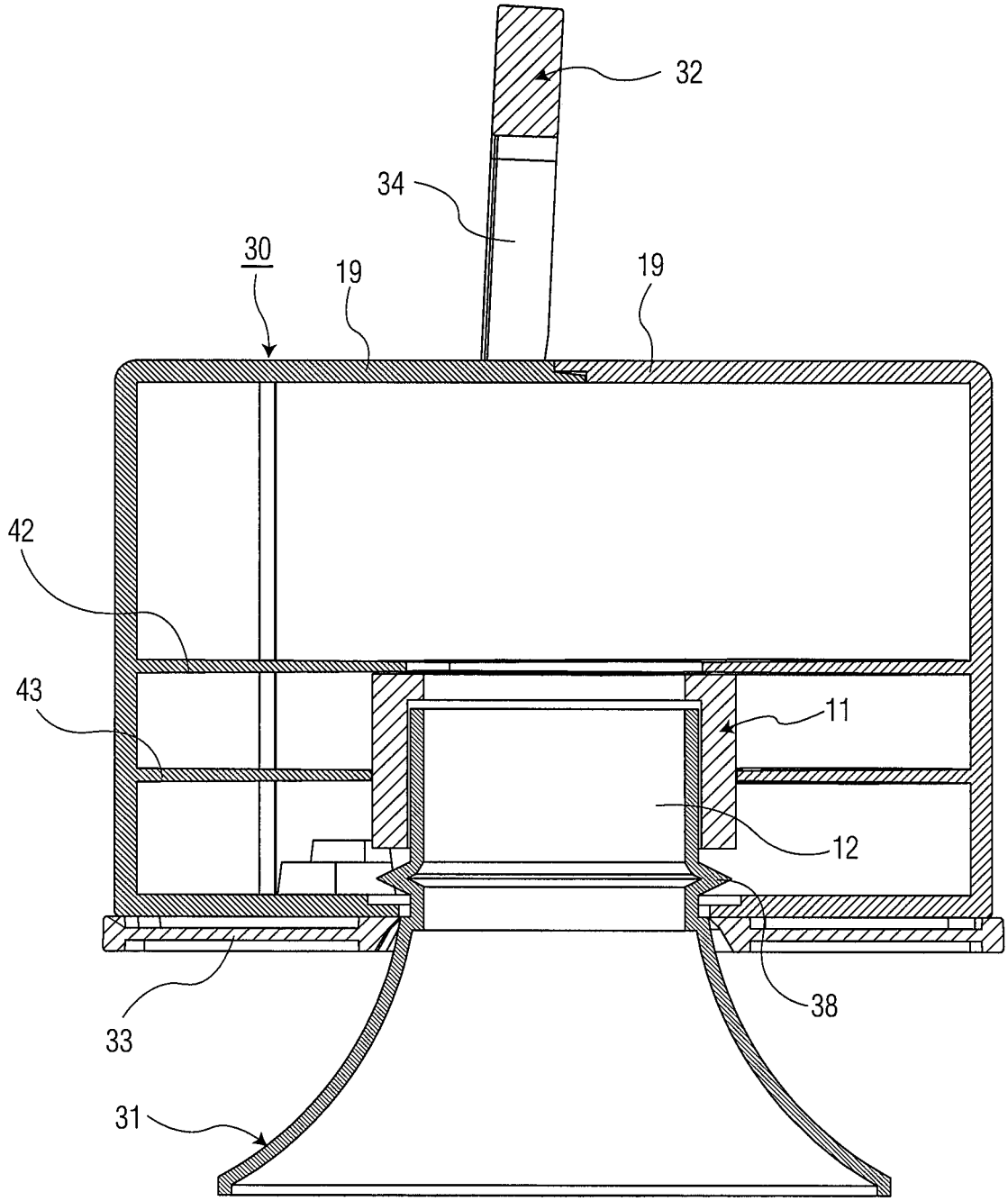
FIG. 7 illustrates a view taken on line 7-7 of FIG. 6.

Referring to FIG. 7, the disc-shaped plate 33 is shaped to fit over an annular collar or projection 38 on the neck 12 of the bottle 31 under the screw cap 11.

Figure 9:
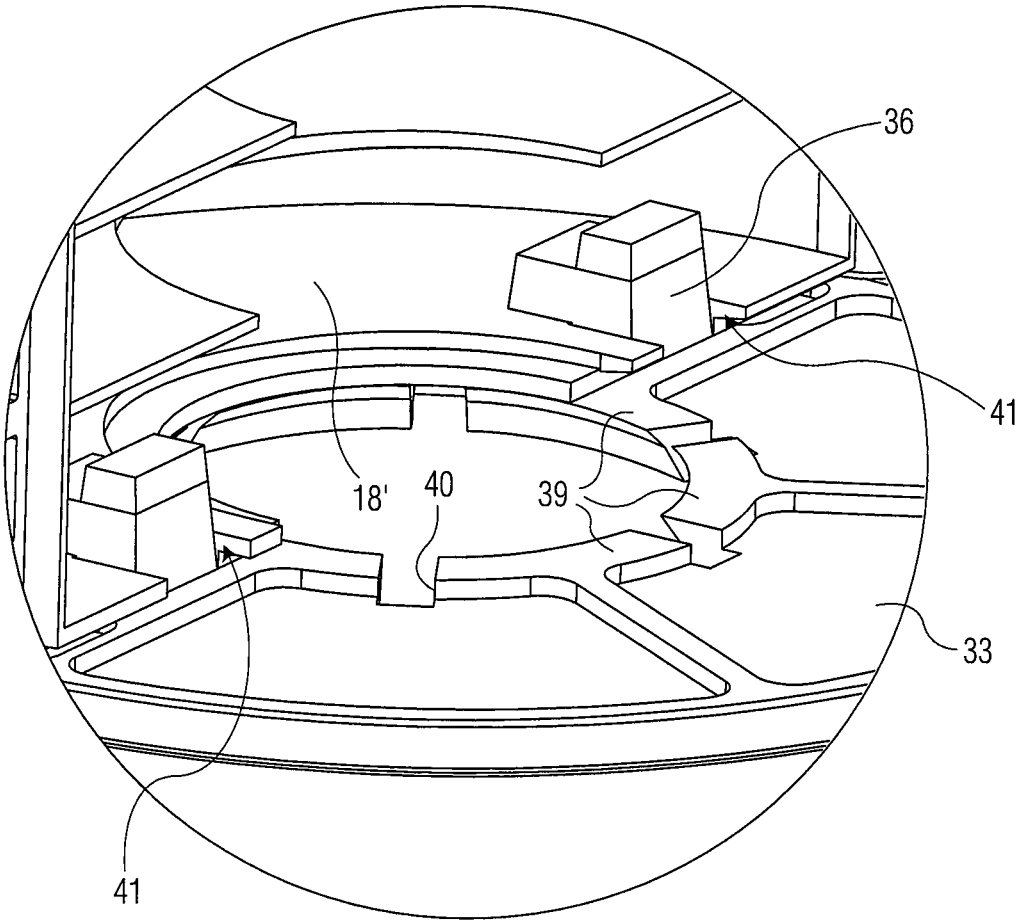
FIG. 9 illustrates an enlarged view of a section of a plate of the handle assembly of FIG. 8.

Referring to FIG. 9, the disc-shaped plate 33 has a central aperture surrounded peripherally by a plurality of circumferentially spaced apart arc-shaped ribs 39 with interruptions 40 therebetween to act as strain relief sections. Each rib 39 is also tapered to allow a rib 39 to flex over the annular collar 38 on the bottle 31 when being snap-fitted onto the bottle 31 and to prevent withdrawal from the bottle 31 after being snap-fitted into place. In this respect, the interruptions 40 allow the ribs 39 to flex independently of each other.

When in place, the plate 33 projects radially inwardly of and under the collar 38.

In use, the handle assembly 32 is mounted on the neck 12 of the bottle 31 prior to threading the cap 11 into place on the bottle 31.

Figure 10:
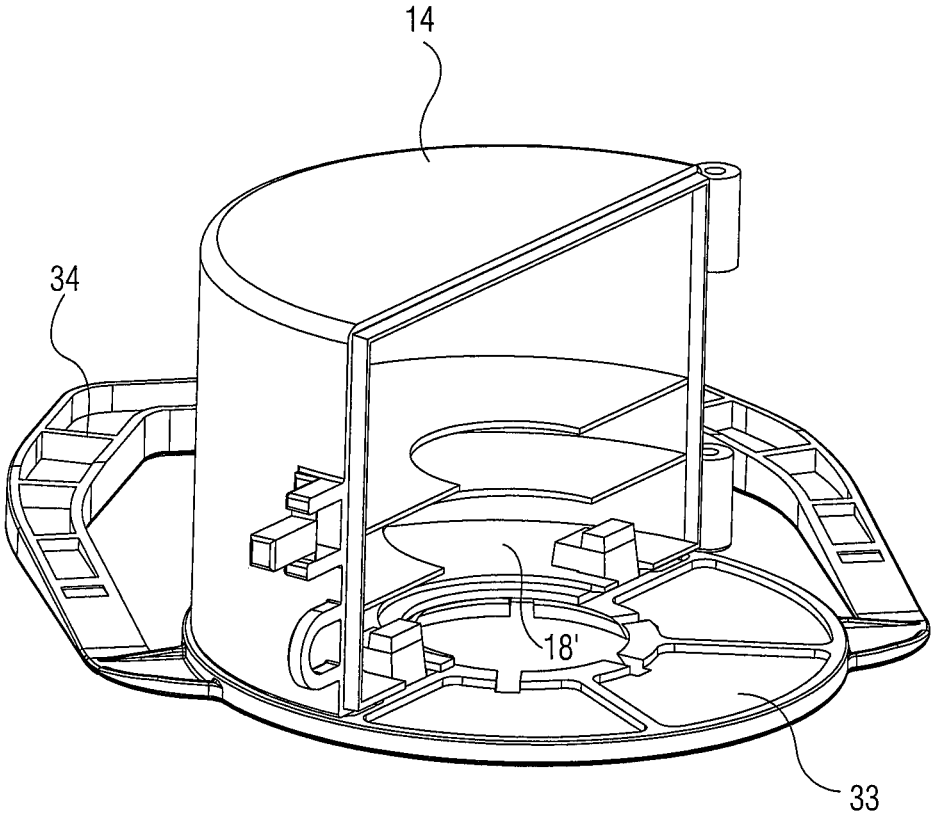
FIG. 10 illustrates a perspective view of one cover part of the modified cover of FIG. 5 mounted on the handle assembly of FIG. 8.

Referring to FIGS. 9 and 10, after the handle assembly 32 and cap 11 are mounted on the bottle 31, one cover part 14 is mounted on the disc-shaped plate 33. To this end, the cover parts 14, 15 each have an extended ledge 18' and the ledge 18' of one cover part 14 is slid into the undercut 37 of the tabs 36 to secure the cover part 14 to the plate 33. As shown in FIG. 9, the ledge 18' is provided with a pair of cutouts 41 to fit around the tabs 36 and, as shown in FIG. 11, is sized to fit under the collar 38 and the cap 11.

Next, the other cover part 15 is pivoted over the plate 33 into the closed position to snap-fit into the first cover part 14 with the extended ledge 18' of the pivoted cover part 15 moving under the cap 11 and the collar 38 on the neck 12 of the bottle 31.

Thereafter, the handle 34 of the handle assembly 32 is pivoted upwardly over the cover 30 to prevent separation of the cover parts 14, 15 from each other. As shown in FIG. 5, the handle 34 is disposed across the two parts 14, 15 so that the parts 14, 15 cannot move out of the closed position.

Figure 11:
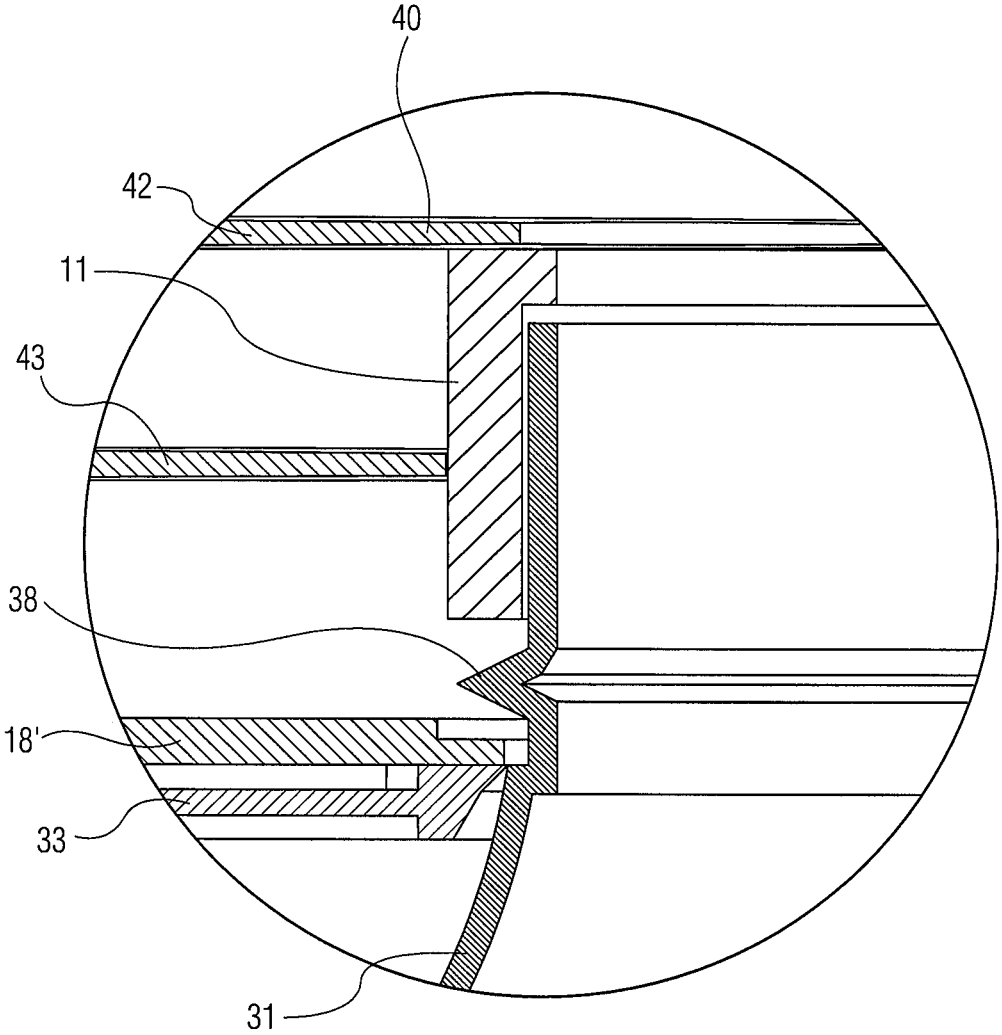
FIG. 11 illustrates a part cross-sectional view of the modified cover of FIG. 5 mounted on a drug product bottle in accordance with the invention.

Referring to FIG. 11, when the cover 30 and handle assembly 32 are in place, the plate 33 of the handle assembly 32 and the ledges 18' of the cover 30 project radially inwardly of the collar 38 so that the cover 30 cannot be lifted off the bottle 31. In addition, the plate 33 rests on the bottle 31 with the lids 17 of the cover parts 14, 15 spaced from the top of the cap 11 and the ledges 18' spaced below the collar 38. As indicated, the cover 30 and handle assembly 32 are rotatable on the bottle 31.

Referring to FIG. 7, the handle 34 allows a user to lift and transport a filled bottle 31 from place to place. The weight of the bottle 31 is transferred via the projections 38 to the plate 33 and thus to the handle 34. The handle 34 is particularly of advantage where a bottle does not have an integral handle.

Referring to FIGS. 7 and 11, the cover 30 also has a pair of radially inwardly directed semi-circular flanges 42, 43 on each part 14, 15, one flange 42 being disposed to rest on the screw cap 11 and the other flange 43 being disposed circumferentially of the screw cap 11.

Once the cover 30 is secured in place, access to the cap 11 is prevented since the cover 30 is locked in the closed position and the cap 11 is located well within the confines of the closed cover 30. In addition, rotation of the covers 30 is not transmitted to the cap 11.

Typically, the handle assembly 32 is mounted on a bottle 31 before the screw cap 11 is put in place. However, the disc-shaped plate 33 may be sized to slide over both the cap 11 and collar 38 so as to allow the screw cap 11 to be placed on the bottle 31 before applying the handle assembly 32.

The invention thus provides a cover for a drug product bottle that maintains and protects a drug product within the bottle from inadvertent or unauthorized removal of a cap from a neck of the bottle.

The invention also provides a relatively simple structure that provides a lockout for a drug product storage bottle and a tamper evident seal for a drug product storage bottle.

What is claimed is:

1. In combination, a drug product bottle having a neck and a screw cap threadably secured to said neck; and a cover mounted over said screw cap and resting on said neck, said cover having a pair of parts hingedly secured together to move between an open position and a closed position in facing relation to each other to form a cup shape in said closed position; each said part having a semi-cylindrical periphery, a semi-circular lid and a radially inwardly directed ledge along a bottom edge of said semi-cylindrical periphery to fit under said screw cap in said closed position.

2. The combination as set forth in claim 1 wherein said cover rests on said neck in rotatable relation therewith in said closed position and is spaced from a top of said cap in said closed position.

3. The combination as set forth in claim 1 wherein said cover has a lip projecting from said periphery and said lid of one of said pair of parts for slidable reception within the other part of said pair of parts in said closed position to seal said pair of parts together in face-to-face manner.

4. The combination as set forth in claim 1 wherein said cover has a locking means for e ring said pair of parts together in said closed position.

5. The combination as set forth in claim 4 wherein said locking means includes a radially directed integral abutment with a slot of rectangular shape on said periphery of one of said pair of parts and an integral tab with a barb on the other part of said pair of parts sized to slide through said slot and to engage behind said abutment in said closed position.

6. The combination as set forth in claim 1 wherein said cover further comprises a pair of radially inwardly directed semi-circular flanges on each of said pair of parts, one of said flanges being disposed to rest on said screw cap and the other of said flanges being disposed circumferentially of said screw cap.

7. In combination, a drug product bottle having a neck and a screw cap threadably secured to said neck; and a cover mounted over said screw cap and resting on said neck, said cover having a pair of parts hingedly secured together to move between an open position and a closed position in facing relation to each other to form a cup shape in said closed position; each said part having a semi-cylindrical periphery, a semi-circular lid and a radially inwardly directed ledge along a bottom edge of said semi-cylindrical periphery to fit under said screw cap in said closed position; and a handle assembly including a disc-shaped plate fitted over said neck of said bottle and having a pair of tabs slidably receiving said ledge of one of said parts of said pair of parts to fix said one part in said open position to said plate and a U-shaped handle secured to said plate for movement between a first position extending radially from said plate and a second position extending perpendicularly from said plate.

8. The combination as set forth in claim 7 wherein said neck of said bottle has an annular collar under said screw cap and said plate projects radially inwardly of and under said collar.

9. The combination as set forth in claim 8 wherein said ledge of each of said pair of parts of said cover projects radially inwardly of and under said collar.

10. The combination as set forth in claim 8 wherein said disc-shaped plate has a central aperture and a plurality of circumferentially spaced apart arc-shaped ribs about said central aperture.

11. The combination as set forth in claim 10 wherein each said rib is tapered to allow said rib to flex over said annular collar when being fitted onto said bottle and to prevent withdrawal from said bottle after being fitted into place.

12. The combination as set forth in claim 7 wherein said other part of said pair of parts of said cover is disposed to move over said plate from said open position to said closed position.

13. The combination as set forth in claim 7 wherein said handle is of U-shape and is disposed over said pair of parts in said closed position to prevent separation of said pair of parts from each other.

14. A cover for mounting over a screw cap on a neck of a drug product bottle, said cover comprising:

a pair of parts hingedly secured together to move between an open position and a closed position in facing relation to each other to form a cup shape in said closed position;

each said part having a semi-cylindrical periphery, a semi-circular lid and a radially inwardly directed ledge along a bottom edge of said semi-cylindrical periphery to fit under the cap of the bottle in said closed position;

a lip projecting from said periphery and said lid of one of said pair of parts for slidable reception within the other part of said pair of parts in said closed position to seal said pair of parts together in face-to-face manner; and a handle assembly including a disc-shaped plate having a pair of tabs slidably receiving said ledge of one of said parts of said pair of parts to fix said plate to said one part in said open position and a U-shaped handle secured to said plate for movement between a first position extending radially from said plate and a second position extending perpendicularly from said plate.

15. A cover as set forth in claim 14 further comprising a locking means for securing said pair of parts together in said closed position.

16. A cover as set forth in claim 10 wherein said locking means includes a radially directed integral abutment with a slot of rectangular shape on said periphery of one of said pair of parts and an integral tab with a barb on the other part of said pair of parts sized to slide through said slot and to engage behind said abutment in said closed position.

17. A cover as set forth in claim 16 wherein said abutment is disposed adjacent an edge of said one part facing the other part.

18. A cover as set forth in claim 16 wherein each part of said pair of parts is made of plastic.

19. A cover as set forth in claim 14 further comprising an aligning loop on each part of said pair of parts for receiving a fastening mechanism.

20. A cover as set forth in claim 14 wherein said pair of parts are integrally hinged together.

21. A cover as set forth in claim 14 wherein one of said parts of said pair of parts has two hollow ears, the other part of said pair of parts has single hollow ear in alignment with said ears of said one part and a pin passes through each of said ears to secure said pair of parts together in hinged manner.

22. A cover as set forth in claim 14 wherein said other part of said pair of parts is disposed to move over said plate from said open position to said closed position.

23. A cover as set forth in claim 14 wherein said handle is of U-shape and is disposed over said pair of parts in said closed position to prevent separation of said pair of parts from each other.

* * * * *